US005348789A

United States Patent [19]

Hellwig

[11] Patent Number: 5,348,789

[45] Date of Patent: Sep. 20, 1994

[54] CAMOUFLAGE NET

[75] Inventor: Manfred Hellwig, Öhringen, Fed. Rep. of Germany

[73] Assignee: C. F. Ploucquet GmbH & Co., Fed. Rep. of Germany

[21] Appl. No.: 728,496

[22] Filed: Jul. 11, 1991

[30] Foreign Application Priority Data

Jul. 21, 1990 [DE] Fed. Rep. of Germany ..... 4023287

[51] Int. Cl.[5] ..... B32B 3/10; B32B 7/00; D04B 1/00

[52] U.S. Cl. ..... 428/135; 428/131; 428/134; 428/137; 428/245; 428/253; 428/254; 428/255; 428/365; 428/379; 428/919; 428/920; 428/921

[58] Field of Search ..... 428/245, 253, 254, 255, 428/919, 920, 921, 365, 379, 131, 134, 135, 137

[56] References Cited

U.S. PATENT DOCUMENTS

| | | | |
|---|---|---|---|
| 4,034,375 | 7/1977 | Wallin | 428/256 |
| 4,064,305 | 12/1977 | Wallin | 428/252 |
| 4,529,633 | 7/1985 | Karlsson | 428/49 |
| 4,645,704 | 2/1987 | Hellwig | 428/209 |
| 4,659,602 | 4/1987 | Birch | 428/88 |
| 5,056,817 | 10/1991 | Fuller | 428/919 |

*Primary Examiner*—George F. Lesmes
*Assistant Examiner*—Terrel Morris
*Attorney, Agent, or Firm*—Jenner & Block

[57] ABSTRACT

A camouflage net made from a flame-retardant material includes a support material of polyester fibers in a perforated structure, which is provided with a coating of a flame-retardant polymer, that in turn is coated with infrared camouflage paint. The support material is a knitted fabric of polyester fibers into which metal fibers are inserted.

15 Claims, 1 Drawing Sheet

CAMOUFLAGE NET

FIELD OF THE INVENTION

The invention relates to camouflage nets and in particular to nets having microwave absorbent characteristics and desirable thermal and infrared characteristics.

BACKGROUND OF THE INVENTION

Camouflage nets are used to camouflage buildings as well as fixed and mobile military installations, such as, for example, vehicles, armored vehicles and the like. Such camouflage nets should not only provide camouflage from infrared cameras and thermal imaging detectors but also from radar detection. Camouflage should therefore be provided in the infrared, thermal imaging, extremely high and super high frequency radar beam range.

The purpose of the camouflage net is to prevent microwaves which impinge upon any object from being reflected by that object. It should also prevent identification by sensors operating in the infrared and thermal imaging range. This means that it should not be possible to recognize or identify the objects to be camouflaged by active video receivers in the 0.7–1.8 um range or by passive video receivers in the 3–5 um and 8–14 um range. Various camouflage nets are already known for this purpose.

In German Offenlegugsschrift 33 29 264 there is described a material which is absorbent in the microwave range and which is preferably effective in the 10 GHz range. However one disadvantage here is that it has to be applied to a metal base and is consequently unsuitable for flexible support materials.

In German Offenlegungsschrift 31 17 245 a metallized, roughened pile fabric is specified as the support material. However the metallized pile is present on one side only. This means that the desired reduced reflection of microwave radiation only occurs if the roughened side of the pile fabric faces the microwave transmitter. However the smooth reverse side possesses an almost undamped high reflective power. Another disadvantage is that this material displays very negative behavior in the thermal image range (heat absorption).

German Offenlegungsschrift 38 10 121 describes an open structure of polyester fibers as the support material for a camouflage net. However it has been shown that with this camouflage net the object beneath it is still visible as a thermal image. Also the high polymer content of the material with which the support material is coated, behaves in a very negative manner on the lattice structure or on the jacquard surface of the support material due to a very high level of heat absorption. One further disadvantage is that in the microwave range the polymer coating does not have an absorbent effect.

It is now known that in the atmospheric windows around 26–40 and 92–96 GHz natural objects, such as a grass and plants, behave like black body radiators with an emission level of almost one, whereas military objects, such as armored vehicles, lorries, etc. made of metal have an emission level of approximately zero and therefore a remission level of approximately one. Therefore the latter are ideal reflectors, with one part of the beam being directed, while one part provides a diffused reflection.

This means that with radiometric measurements from above the object to be camouflaged, e.g. a military object, reflects thermal radiation into the sky with a temperature of 30K at 35 GHz and 100K at 94 GHz, whereas the environment radiates as a black body radiator with ambient temperature.

The military object therefore behaves like a very cold target in a warm environment, with the temperature contrast being between 240K and 280K. In this way it can be detected as a cold body with a microwave radiometer. When the sky is overcast and it is still high enough for armored vehicles to be located with a passive microwave seeker head for the final phase guidance of shells and missiles.

SUMMARY OF THE INVENTION

Therefore an object of the present invention is to manufacture a multispectrally effective flame-retardant camouflage net, which gives protection in the visible and near infrared range, displays good damping values over a wide spectrum of the microwave range and is a low emitter in the thermal imaging range. Furthermore the camouflage net of the invention also possess good mechanical strength and flexibility characteristics over the widest possible temperature range.

This object is achieved according to the invention in that the support material is a knitted fabric made from polyester fibers, into which metal fibers are inserted.

Surprisingly it has been shown that the construction of the support material specified by the invention combined with the below described coatings possesses both protection in the visible and near infrared range as well as good damping values in the microwave region and furthermore also produces a thermal image such that the object to be camouflaged cannot be located.

In particular the content of metal fibers ensures such a partial reflection that no gap is produced at this position by complete absorption nor is there any accentuation from the environment.

Particularly good values have been produced in practice when the portion of the metal fibers, which are woven into the knitted fabric, is 5–15%, and preferably approximately 10%.

The best results with respect to camouflaging in a very wide range are produced if, in connection with the metal fibers, the size of the holes or apertures in the support material is selected so that they have a diameter or a width or height of 2–3 mm.

As a result of this development optimal heat exchange or convection is produced and as a result the thermal image is so ideal that it is now practically impossible to distinguish the object to be camouflaged from its surroundings.

The given structure in the form specified by the invention provides for a good circulation of air and heat, but the structure is not so open that the object located behind it is visible as a thermal image.

The shape of the holes is optional, but in practice holes having at least an approximate diamond shape prove to be the most suitable. By selecting the diamond shape, a corresponding reinforcement of the support material and therefore of the camouflage net is accomplished, as a result of which high values for tearing strength and tear growth are achieved.

The holes are advantageously disposed in rows in the support material, preferably with the holes staggered in successive rows.

Tests have shown that particularly good results are achieved if the fibers are knitted more tightly around the holes or if the sections between the rows of holes are knitted more loosely.

After coating the support material with flame-proof coating, the support material to be treated in this way may be coated with a polymer, e.g. polyurethane, which is provided with absorbent pigments which are preferably effective in the microwave range of 10 to 600 GHz.

In a refinement of the invention the polymer may also be provided with a flame-proof coating.

The proportion of absorbent substances with a broadband effect in the microwave range of 10–100 GHz is very important. The admixture to the polymer is preferably in the range of approximately 30–40% by weight, preferably approximately 35% by weight.

Substances having a carbon base, for example, have proved to be suitable as absorbent substances.

A camouflage net according to the invention is described in more detail below with reference to an exemplified embodiment and the drawings.

DETAILED DESCRIPTION OF THE INVENTION

A knitted fabric made of polyester, which for strengthening purposes is configured with diamond-shaped apertures or holes 2 in an open structure, is used as the support material 1 for the camouflage net. The aperture widths of the holes are approximately 2–3 mm.

Into the knitted fabric made of polyester fibers are woven up to approximately 10% metal fibers 3. The support material constructed in this way has tearing strength values of 700N/5 cm and tear growth values of over 60N/5 cm.

So as to achieve flame-proofing, the carrier material is provided with a corresponding permanent flame-proofing agent and is simultaneously provided with a moisture-repellent agent. The flame-proofing should be halogen-free and comply with DIN 4102/Sheet 1. The coating is between 20–30 g/m$^2$. The flame-proofing agent can be applied by foularding, for example.

Figure 2:
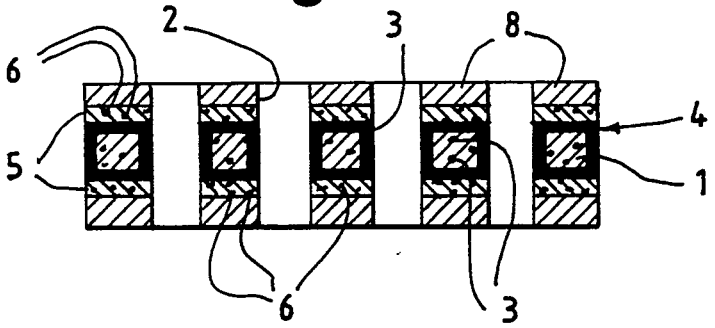
FIG. 2 is a sectional view of the camouflage net shown in FIG. 1.

From FIG. 2 it can be seen that the flame-proofing 4 covers the knitted fabric on all sides including the knitted fabric exposed in the holes.

The support material 1 is pretreated on both sides, i.e., on the front side and on the rear side, with a flame-retardant absorbent polymer layer 5. Care should be taken so that coating proceeds so that the apertures, or holes 2, do not become clogged and that the polymer layer 5 is not so thick that it becomes heated and changes the thermal image characteristics.

A highly colorfast and hydrolysis-resistant polyurethane may preferably be used for the polymer. Mineral substances, such as aluminum hydroxide and/or phosphorous nitrogen compounds, for example, can be used as flame-proofing agents. Other flame-proofing agents which do not separate dioxin and furan can also be used. A fungicide is also preferably added.

The polymer 5 represents the support layer for absorbent pigments 6. The absorbent pigments serve to absorb radar beams in a microwave range of 10–100 GHz. A preferred composition of the polymer coating 5 is described below: To 100 parts polymer in liquid form are mixed 30% by weight a flame-proofing agent, 35% by weight absorbent pigments and 1% by weight fungicide. The consistency to be produced for the application of this layer to the support material 1 is achieved by dilution with aromatic solvents.

The polymer coating is approximately 40–45 g/m$^2$.

Finally a low-emission IR paint coating 8 is applied to or sprayed on both sides. In this case the camouflage paint binding system is preferably also provided with a fungicide and flame-proofing agent, and care should be taken to ensure that the size of the holes 2 in the support material 1 is altered not at all if possible or at least only slightly.

Figure 1:
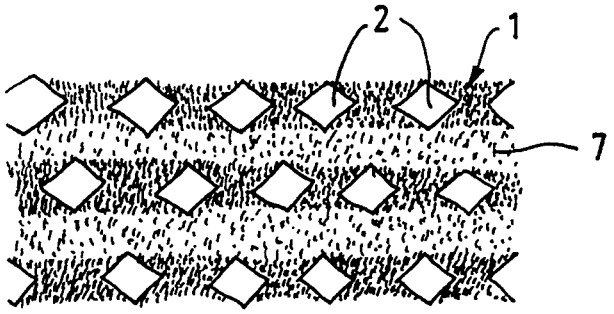
FIG. 1 is a detailed plan view of the camouflage net according to the invention.

From FIG. 1 it is also evident that the density of the knitted polyester fibers is irregular. In the region of the holes 2 the density is greater than in the sections 7 of adjacent rows of holes 2, where the fibers are knitted more loosely.

The following measurement results can be achieved with the camouflage net described above:

1. Radar

Damping values of from −3 dB to −8 dB per m$^2$ are adopted because of the assumed radiation in the vegetative outer field, taking into account cloud cover, ambient temperature and ground vegetation. The camouflage net described here was surveyed as a pilot scheme in a determined aspect angle (e.g. 45 degrees) and azimuth angle of 0 to 360 degrees.

The reduction of the linear mean value resulted in:

35 GHz = −11 dB

94 GHz = −12 dB

2. Thermal Image

The coating layer of 40–45 g/m$^2$ did not produce a negative effect in a large-scale experiment with the thermal image and which did not result in any thermal absorption. (The net size was 6×8 m. The thermal imaging sensor spacing was approximately 800 m. Lorries at the forest edge were camouflaged.)

Thicker coatings and closed coated areas would tend to absorb heat and therefore be visible.

3. Near Infrared

The low-emission IR camouflage paints applied did not produce alterations in the microwave and thermal image ranges.

I claim:

1. A camouflage net comprising: a flame-retardant material having a support material consisting of a knitted fabric of polyester fibers into which a plurality of metal fibers are woven, said knitted support material being configured with a plurality of apertures having a predetermined size and having a plurality of exposed surfaces including a top surface, a bottom surface, and exposed surfaces which define said apertures, a flame proofing coating covering said knitted support material on all of said plurality of exposed surfaces including said exposed surfaces which define said apertures, said knitted support material being further coated with a flame-retardant polymer including a radar absorbent pigment effective in the microwave range of approximately 10–100 GHz, wherein said predetermined size of said apertures is substantially unaffected by said flame proofing coating and said flame retardant polymer.

2. A camouflage net according to claim 1, wherein 5–15% of said metal fibers are contained in the knitted support material.

3. A camouflage net according to claim 1, wherein said apertures are configured generally in a diamond shape.

4. A camouflage net according to claim 1 wherein said apertures are located in said support material in rows.

5. A camouflage net according to claim 4, wherein said apertures are located in a staggered relationship in successive rows.

6. A camouflage net according to claim 4 wherein said knitted support material is knitted with more than one density of fibers and wherein said density of fibers around said apertures is greater than said density of fibers in regions spaced apart from said apertures.

7. A camouflage net according to claim 1 wherein said polymer is polyurethane.

8. A camouflage net according to claim 1 wherein said polymer includes a flame-proofing agent.

9. A camouflage net according to claim 1, wherein said radar absorbent pigments are present in said polymer in a quantity which is approximately 30–40% by weight.

10. A camouflage net according to claim 9 wherein said radar absorbent pigments are present in said polymer in a quantity which is approximately 35% by weight.

11. A camouflage net according to claim 1 wherein in 100 parts of said polymer contain approximately 30% by weight a flame protection material, approximately 1% by weight a fungicide and approximately 35% by weight an absorbent pigment.

12. A camouflage net according to claim 1, wherein said radar absorbent pigment is provided with a carbon base.

13. A camouflage net according to claim 1 wherein said polymer has a density of 40–45 $g/m^2$.

14. A camouflage net according to claim 1 wherein approximately 10% of said metal fibers are contained in said knitted support material.

15. A camouflage net according to claim 1 wherein said predetermined size of said apertures comprises a diameter or height or width in the range of about 2–3 mm.

* * * * *